US005956778A

United States Patent [19]

Godoy

[11] Patent Number: 5,956,778

[45] Date of Patent: Sep. 28, 1999

[54] DEVICE FOR REGULATING THE LENGTH OF A SWIMMING GOGGLES STRAP

[75] Inventor: Carlos Alberto Godoy, Cogorno, Italy

[73] Assignee: Cressi Sub S.P.A., Genoa, Italy

[21] Appl. No.: 09/034,907

[22] Filed: Mar. 4, 1998

[30] Foreign Application Priority Data

Jun. 20, 1997 [IT] Italy ..... FI97A0148

[51] Int. Cl.[6] ..... A61F 9/02

[52] U.S. Cl. ..... 2/428; 2/452; 24/585

[58] Field of Search ..... 2/428, 430, 452, 2/426, 429; 351/43; 24/170, 191, 585

[56] References Cited

U.S. PATENT DOCUMENTS 4,607,398 8/1986 Faulconer ..... 2/452
4,776,045 10/1988 Mysliwiec et al. ..... 2/426
5,555,571 9/1996 McCaffrey ..... 2/428
5,617,588 4/1997 Canavan et al. ..... 2/428

*Primary Examiner*—Peter Nerbun
*Attorney, Agent, or Firm*—Browdy and Neimark

[57] ABSTRACT

A device for regulating the length of a swimming goggles strap (5), said goggles comprising a pair of supporting frames (1) providing a couple of parallel fins (3) radially extending from the outer side of each frame, the free ends of each couple of the fins being joined by a respective pivot (4), strap (5) wrapping around each pivot and having a plurality of transverse stop-ribs (7). The device comprises a respective stop lever (9) and a tooth (8) extending from it, engageable with one of ribs (7), said stop lever comprising a first arm (11), having a first end pivotally connected to fins (3) and a second end abutting against said frame, and a second arm (10), from the substantially intermediate section of which said tooth transversely extends, said second arm having a free first end for operating and a second end which is integral to the second end of said first arm.

5 Claims, 1 Drawing Sheet

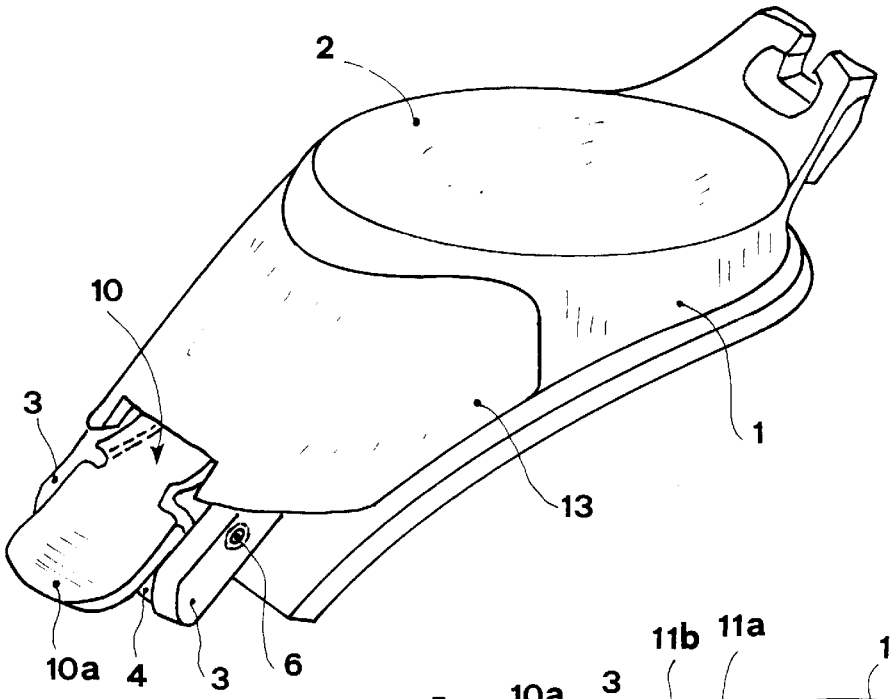
Fig. 1
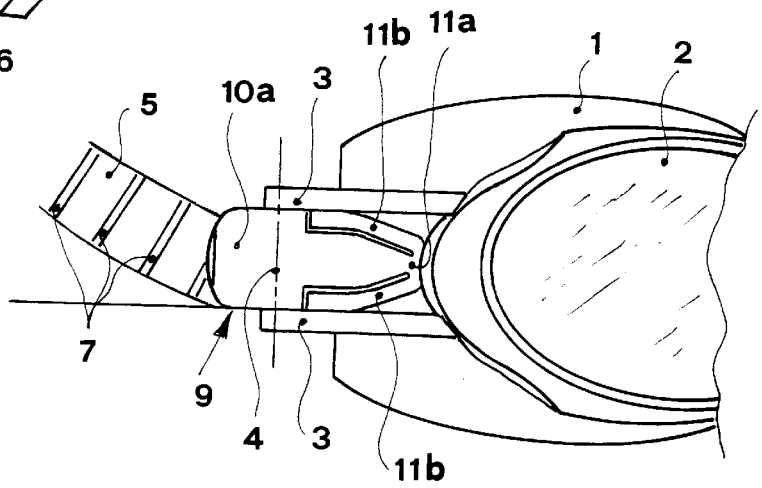
Fig. 2
Fig. 3
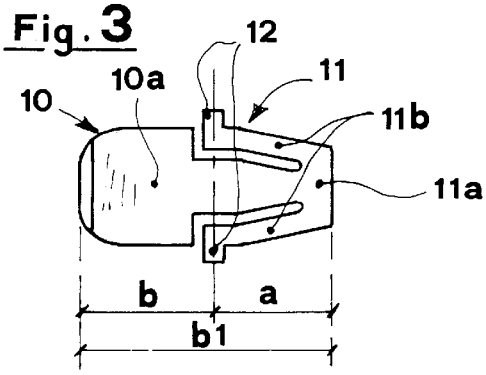
Fig. 4
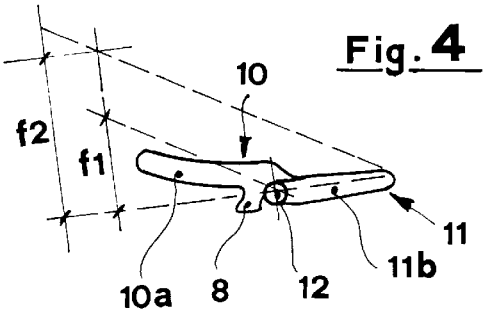

DEVICE FOR REGULATING THE LENGTH OF A SWIMMING GOGGLES STRAP

DESCRIPTION

1. Field of the Invention

This invention relates to a device for regulating the length of the strap of a pair of swimming goggles.

2. Background Art

Swimming goggles are usually formed by a pair of frames, hingedly connected to each other, having a strap that surrounds the wearer's head and means for regulating the length of said strap.

In general, the strap length regulation is provided by means of a buckle, slidable along the strap and connected to one end thereof. Such a regulation requires the swimmer to take off the goggles to fulfil the operation, with all the drawbacks of the case, in particular that of demanding the execution of several attempts before obtaining the optimal regulation. Besides, this system requires the strap to be hand-loosened from the buckle around which it is wrapped, that being a very uncomfortable operation, particularly if the wearer's hands are cold and wet.

In scuba masks the same problem occurs and the most used solutions provide that the length of the strap can be regulated without making the swimmer take off his mask. In a known solution of that kind the ends of the strap wrap around respective pivots provided on each side of the mask. The strap has transversal ribs, acting like stop means, which cooperate with a stop tooth extending from a lever elastically pressed against them. Said lever can be lifted by the wearer against the elastic strength, without taking off the mask, so that the sliding of the strap to a new position is allowed. The elastic strength is provided in some cases by a spring, in other ones by the resilience of the lever, which is flexed to move away the stop tooth by the strap and to make the latter slide.

A frame for swimming goggles is smaller than the one of a scuba mask and for this reason the solutions adopted for scuba masks are unsuitable for swimming goggles. In fact, a force has to be applied to the free end of the lever, to lift its arm against the elastic reaction force. The two forces can be regulated by varying both the length and the resiliency of the spring or of the lever, considering that the value of the lifting has to be high enough to let the ribs pass under, without requiring to the wearer any excessive effort. The dimensions of scuba masks permit solving the problem without any particular difficulty, by making lever arms of a certain length (up to several centimeters), which are able to achieve sizeable deflections.

The application of a similar solution to swimming goggles, without designing a completely different frame structure, would necessarily involve an excessive overall size of the lever, its length having to be such to permit a sufficient deflection. If a conventional structure is desired for the frame, i.e. with the fulcrum point duly spaced out from the frame itself by way of two fins extending from it, the lever arm, for the above cited reasons, can't exceed a certain length and consequently the value of the deflection can't be high enough to permit a good working of the regulation system.

SUMMARY OF THE INVENTION

It is an object of the present invention to solve the above described problems, providing a device for the regulation of the length of the strap of a pair of swimming goggles which, operating by way of a stop lever of a reduced overall size, actually lets the wearer easily catch the end thereof to duly lift it and to free the transversal ribs of the strap from the stop tooth of the lever.

This object is achieved with the device for regulating the length of the strap of a pair of swimming goggles according to the present invention, which comprises a stop lever with a first arm, having a first end pivotally connected to fins radially extending from the free side of the frame and a second end abutting against the frame itself, and with a second arm, from the substantially middle section of which a tooth transversely extends transverse ribs of the strap. The second arm has an actuating free first end and a second end which is integral to the second end of said first arm.

In particular and advantageously the first arm is in the shape of a fork comprising a base and a couple of brackets and the second arm is made up by a tongue, having a length which is substantially twice as much the one of the brackets, integral to the internal rim of the fork base so as to result substantially coplanar to it.

BRIEF DESCRIPTION OF THE DRAWINGS

Other characteristics and advantages of the length-regulating device according to the present invention will be apparent from the following description of its embodiment, which is to be intended only as an example and not a limitation with reference to the enclosed drawings, wherein:

FIG. 1 shows a partial perspective view of a pair of swimming goggles with the regulating device according to the invention;

FIG. 2 is a partial plan view of a pair of swimming goggles with the regulating device according to the invention in a different embodiment of its frame;

FIG. 3 shows a plan view of a stop lever to be used in the device according to the invention;

FIG. 4 is a side view of the stop lever of FIG. 3.

DESCRIPTION OF THE PREFERRED EMBODIMENT

With reference to the above figures, the device according to the present invention is mounted on a pair of swimming goggles comprising a pair of frames 1 (only one of which is shown in the figures), substantially elliptic-shaped, each supporting a lens 2. The frames are connected to each other at one side by way of a known hinge system. This configuration substantially corresponds to that shown in FIG. 2, while in FIG. 1 each lens 2 and its frame 1 are formed as a unity in transparent material. A couple of parallel fins 3 radially extends from the outer side of each frame 1, the ends of said fins being joined by a pivot 4 around which is wrapped, in a known way, a strap 5 to hold the goggles in position around the swimmer's head. Strap 5 is provided with transversal ribs 7, extending from one side thereof.

Fins 3 pivotally support a stop lever 9, shown in particular in FIGS. 3 and 4, made up by a tongue 10, from one side of which a tooth 8 transversally extends in a substantially intermediate position, and by a fork 11, comprising a base 11*a* and a couple of brackets 11*b*, having a length which is substantially half as much the one of tongue 10. Tongue 10 is integral to the internal rim of base 11*a* of fork 11, so as to be substantially coplanar to the fork and to extend from it cantileverly. Two pivots 12 externally project from the free ends of brackets 11*b*, to pivotally engage in seats 6 formed in fins 3 in an intermediate position with respect to their longitudinal axis.

Stop lever 9 is placed so that base 11*a* of fork 11 is in contact with the external surface of frame 1, while the free end 10*a* of tongue 10, slightly turned upward, provides a comfortable hold to the wearer's fingers when they have to lift it, by way of the application of a force.

A side fairing 13, of a kind known for similar purposes and commonly indicated as a "shell", is snap-fixed to frame 1, so as to partially hide, with aesthetic and hydrodynamic functions, fins 3 and lever 9, letting the free end 10*a* of tongue 10 uncovered to permit its operation.

The device according to the invention works in the following way. A traction of the free end 10*a* of tongue 10, thanks to the abutment of base 11*a* of fork 11 against the frame, causes the rotation of the tongue with respect to a fulcrum axis substantially coincident with said base. In this way, stop tooth 8 is lifted and becomes disengaged from a respective rib 7, thus allowing strap 6 to slide around pivot 4. As a consequence, the swimmer is able to increase the length of the strap, bringing it to its optimal value, while the release of tongue 10 causes the lowering of tooth 8, its engagement with a new rib 7 and the consequent block of the sliding of the strap. Tooth 8 is so shaped as to permit the sliding of the strap in an opposite direction with respect to that described above, to reduce its length and tighten it around the head, without requiring the operating of tongue 10.

The particular configuration of lever 9 permits, for a given size of the regulating device, a virtual increase in the length of the lever arm 11, which, as it is said above, is made up by the whole extension of tongue 10, achieving a much more consistent deflection than the one that could be achieved with a conventional lever fixed in correspondence of seats 6. As a matter of fact, with reference in particular to FIGS. 3 and 4, the increase of the deflection f1 up to the value f2, at least equal to the height of transversal ribs 7 of strap 5, is achieved by raising, in a virtual way, the projection b of the tongue, represented as a beam supported at one end, up to the value of the overall size of the beam, equal to:

$$b1=a+b.$$

In this way the regulation is easy and ergonomic, and can be performed by means of a device having a reduced size and with an actual conventional configuration of the frame in the connection zone of the strap.

Variations and/or modifications can be brought to the device for regulating the length of the strap of a pair of swimming goggles according to the present invention, without departing from the scope of the invention itself, as defined in the appended claims.

I claim:

1. A device for regulating the length of a strap (5) engaged on swimming goggles, said goggles comprising a pair of supporting frames (1) for respective lenses (2), hingedly connected to each other, each frame having a pair of parallel fins (3) radially extending from an outer side of said frame, free ends of each pair of said fins being joined by a respective pivot (4), said strap adapted to wrap around each said pivot and having a plurality of transverse stop-ribs (7), said device comprising a respective stop lever (9) having a tooth (8) extending from said lever, engageable with one of said stop-ribs, said stop lever comprising a first arm (11), having a first end pivotally connected to said fins and a second end adapted to engage against said frame, and a second arm (10) having a substantially intermediate section on which said tooth transversely extends, said second arm having a free first end for operating the device and a second end which is integral to the second end of said first arm.

2. Device according to claim 1, wherein said first arm is made up by a fork (11) comprising a base (11*a*) and a pair of brackets (11*b*) and said second arm is made up by a tongue (10*a*), having a length which is substantially twice that of one of said brackets, said tongue being integral to said base and extending substantially coplanar to said base.

3. Device according to claim 2, wherein two pivots (12) extend from free ends of said brackets, to pivotally engage with corresponding seats (6) formed in a substantially intermediate position of said fins.

4. A device for regulating the length of a strap (5) engaged on swimming goggles, said goggles comprising a pair of supporting frames (1) for respective lenses (2), hingedly connected to each other, each frame having a pair of parallel fins (3) radially extending from an outer side of each said frame, free ends of each pair of said fins being joined by a respective pivot (4), said strap wrapping around each said pivot and having a plurality of transverse stop-ribs (7), said device comprising a respective stop lever (9) having a tooth (8) extending from said lever, engageable with one of said stop-ribs, said stop lever comprising a first arm (11), having a first end pivotally connected to said fins and a second end adapted to engage against said frame, and a second arm (10) having a substantially intermediate section where said tooth transversely extends, said second arm having a free first end for the device and a second end which is integral to the second end of said first arm;

wherein said first arm is made up by a fork (11) comprising a base (11*a*) and a pair of brackets (11*b*) and said second arm is made up by a tongue (10*a*), having a length which is substantially twice that of one of said brackets, said tongue being integral to said base and extending substantially coplanar to said base.

5. Device according to claim 4, wherein two pivots (12) extend from free ends of said brackets, to pivotally engage with corresponding seats (6) formed in a substantially intermediate position of said fins.

* * * * *